United States Patent [19]

Goldstein et al.

[11] Patent Number: 4,661,080

[45] Date of Patent: Apr. 28, 1987

[54] TOY RACING SET WITH EXPLODING RACEWAY

[75] Inventors: Samuel M. Goldstein, Los Angeles; Wayne R. Halford, Manhattan Beach, both of Calif.

[73] Assignee: Mattel, Inc., Hawthorne, Calif.

[21] Appl. No.: 746,223

[22] Filed: Jun. 18, 1985

[51] Int. Cl.[4] ..... A63H 33/00; A63H 33/02; A63F 9/14

[52] U.S. Cl. ..... 446/4; 446/455; 446/429; 273/1 GE; 273/86 H

[58] Field of Search ..... 446/138, 444, 429, 430, 446/4, 5, 6, 168, 172, 173, 174, 423, 476, 478, 455, 467; 273/1 GE, 87.2, 87.4, 86 R, 86 H, 86 D, 86 E

[56] References Cited

U.S. PATENT DOCUMENTS

| | | | |
|---|---|---|---|
| 1,661,429 | 3/1928 | Jade | 446/476 |
| 1,750,519 | 3/1930 | Jade | 446/476 |
| 2,442,526 | 6/1948 | Wright | 446/476 X |
| 3,029,557 | 4/1962 | Lemelson | 46/196 |
| 3,108,398 | 10/1963 | Einfalt | 446/444 |
| 3,359,920 | 12/1967 | Iammatteo | 273/86 R |
| 3,494,617 | 2/1970 | Glass et al. | 273/1 GE |
| 3,503,613 | 3/1970 | Caya | 273/87.4 |
| 3,599,365 | 8/1969 | Carver | 46/202 |
| 3,600,849 | 8/1971 | Faller | 446/429 |
| 3,633,308 | 1/1972 | Yang | 46/243 |
| 3,734,500 | 5/1973 | Cooper | 273/85 |
| 4,108,437 | 8/1978 | De Anda et al. | 446/429 X |
| 4,185,409 | 1/1980 | Cheng | 46/1 |
| 4,249,733 | 2/1981 | Eddins et al. | 446/444 X |
| 4,254,576 | 3/1981 | Matsumoto et al. | 446/444 |
| 4,262,445 | 4/1981 | Orenstein | 446/308 |
| 4,355,807 | 10/1982 | Prehodka | 273/86 R |
| 4,373,293 | 2/1983 | Kakizaki et al. | 273 R X/86 X |
| 4,383,688 | 5/1983 | Prehodka | 273/86 |
| 4,488,373 | 12/1984 | Glickson et al. | 446/4 |
| 4,513,967 | 4/1985 | Halford et al. | 273/86 D X |
| 4,575,346 | 3/1986 | Ogawa | 446/444 X |

FOREIGN PATENT DOCUMENTS

| | | | |
|---|---|---|---|
| 467788 | 6/1937 | United Kingdom | 446/444 |
| 8133 | 3/1916 | United Kingdom | 446/4 |
| 2012601 | 8/1979 | United Kingdom | 446/4 |

*Primary Examiner*—Robert A. Haffer
*Assistant Examiner*—D. Neal Muir
*Attorney, Agent, or Firm*—Karon, Morrison & Savikas

[57] ABSTRACT

A toy playset including a bridge which may be used in a road racing set to emulate the occurence of an explosion. The playset includes a launcher and a toy bridge with a track portion and an actuating device. The track portion includes at least one element thereof which may be operated by the actuating device to project a toy vehicle passing thereover in a manner simulating an explosion.

3 Claims, 12 Drawing Figures

TOY RACING SET WITH EXPLODING RACEWAY

BACKGROUND OF THE INVENTION

This invention relates to toys, and more particularly, to an accessory for emulating an explosion in a toy road racing arrangement.

There have been many toy road racing arrangements devised which include features which add to the excitement of the action. For example, features have been suggested which increase the emotional appeal of the arrangement by causing collisions between toy vehicles. Other arrangements have been devised which provide impediments to vehicle travel or simulate an accident and to enhance the excitement.

The present invention increases the fascination of a toy road racing arrangement by simulating an explosion which may, depending upon the skill of the operator, occur while a toy vehicle is passing over the particular accessory. Thus, the present invention both adds excitement and provides for increasing the hand, eye cordination of the operator.

It is an object of the present invention to enhance the excitement of toy road racing arrangements.

It is another object of this invention to provide a device for use in a toy road racing arrangement which through use may increase the hand, eye cordination of the operator.

SUMMARY OF THE INVENTION

These and other objects and features of the invention are accomplished by a toy which may be used as an accessory in a toy racing set to emulate the occurrence of an explosion. The toy may be given the appearance of a bridge or some other device which would be normally found in or adjacent to a roadway. The toy includes a track portion and an actuating device. The track portion includes at least one element which forms a portion of the track and is hinged at one side of the track. The actuating device is connected to the hinged element by means such that manipulation of the actuating device causes the hinged element to rotate rapidly about its axis throwing anything (such as a toy vehicle) passing over it into the air to emulate an explosion.

In the preferred embodiment which has the appearance of a bridge, other hinged elements are provided which are uniquely actuated by the first hinged element to enhance the simulation of an explosion and provide additional excitement.

Other objects, features, and advantages of the invention will become apparent upon reference to the specification taken in conjunction with the drawings in which like elements are referred to by like reference characters throughout the several views.

DESCRIPTION OF THE PREFERRED EMBODIMENT

Figures 1, 5:
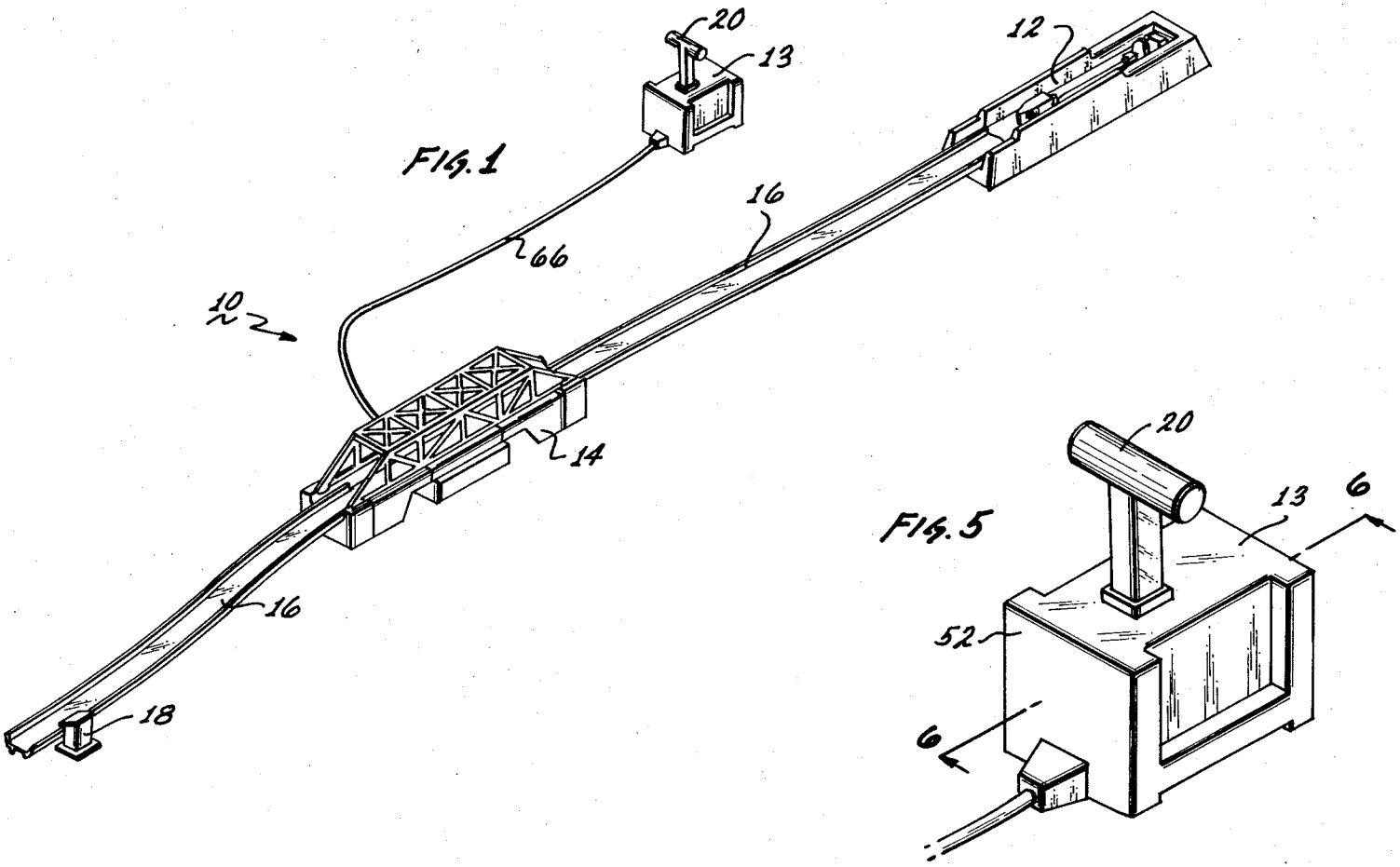
FIG. 1 is a perspective view of a toy arrangement constructed in accordance with the invention.
FIG. 5 is a perspective view of an actuator device used in the arrangement shown in FIG. 1.

Referring now to FIG. 1, there is shown an arrangement 10 constructed in accordance with the present invention. The arrangement 10 includes a launching device 12, an actuator 13, a bridge 14, a track 16 leading from the launching device 12 through the bridge 14 and continuing therebeyond, and a counting device 18. Although the arrangement 10 of FIG. 1 constitutes a playset in its own right, the bridge 14 and the actuator 13, as well as the launching device 12 may also be used as portions of a toy racing set for adding a substantial element of excitement thereto.

In use, a toy vehicle is placed in the launching device 12 by a first or second player and impelled therefrom along the track 16. The toy vehicle (which is not shown in FIG. 1) proceeds towards the bridge 14. Either player may then act as operator of the arrangement 10 and depress a plunger 20 on the actuator 13 which causes the portions of the bridge 14 to simulate an explosion. If the toy vehicle is passing over the bridge 14 at that time, the vehicle is thrown from the bridge. If the vehicle has already passed over the bridge 14 at the time of the simulated explosion, it continues along the track 16 until it reaches the counter 18. That occurrence is counted to give a negative indication of the ability of the operator to affect the "destruction" of the toy vehicle. Thus, the arrangement 10 provides both an exciting occurrence within the operation of a toy racing set and a test for the hand-eye coordination of the operator or operators.

Figure 2:
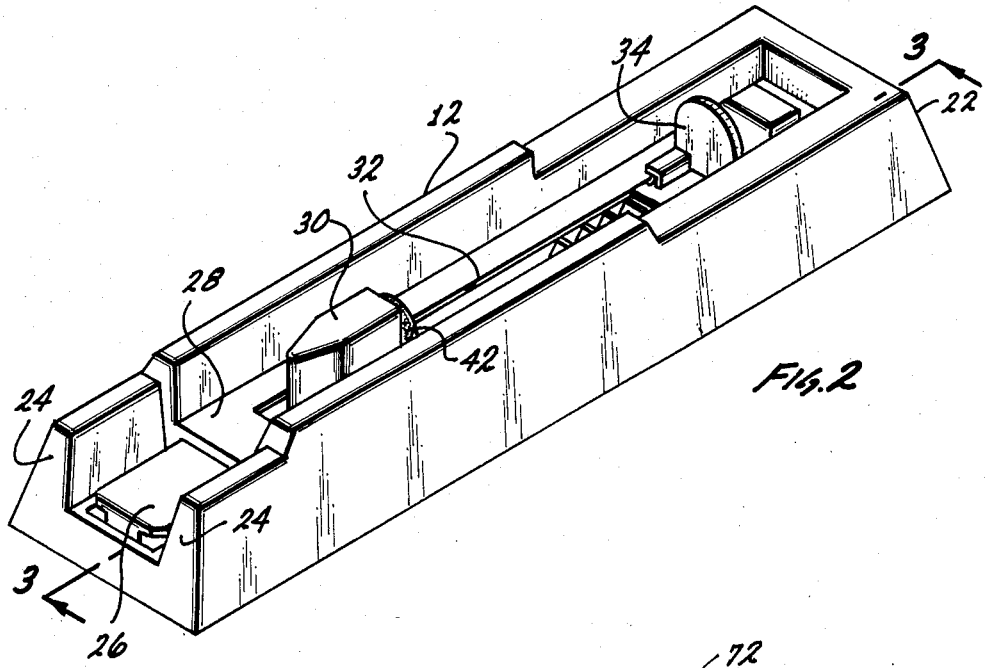
FIG. 2 is a perspective view of a launching device which may be utilized as a portion of the arrangement shown in FIG. 1.

FIG. 2 is an enlarged perspective view of the launching device 12 illustrated in FIG. 1. The device 12 includes a base portion 22 having sidewalls 24 extending upwardly therefrom. Between the sidewalls 24 is a tab 26 to which a section of the track 16 may be connected in a manner well known to the prior art. It will be noted that the top of the tab 26 is positioned below an inner floor 28 of the base 22 by a vertical distance sufficient to allow a track portion held in place by the tab 26 to reach the same height as the floor 28.

A toy vehicle may be constrained within the two sidewalls 24 and positioned in front of (to the left in FIG. 2) an impeller 30. The impeller 30 slides in an opening 32 in the floor 28. Also mounted to slide in the groove 32 is a selector 34.

As is better shown in the cross-sectional views of FIG. 3 and FIG. 4, the impeller 30 has one or more downwardly projecting portions 36 which ride below the floor 28 and to which may be attached one or more rubber bands or other elastic device 38. The device 38 is attached to the base 22 at a projection 40 so that when the impeller 30 is moved to the right as shown in FIG.

Figure 4:
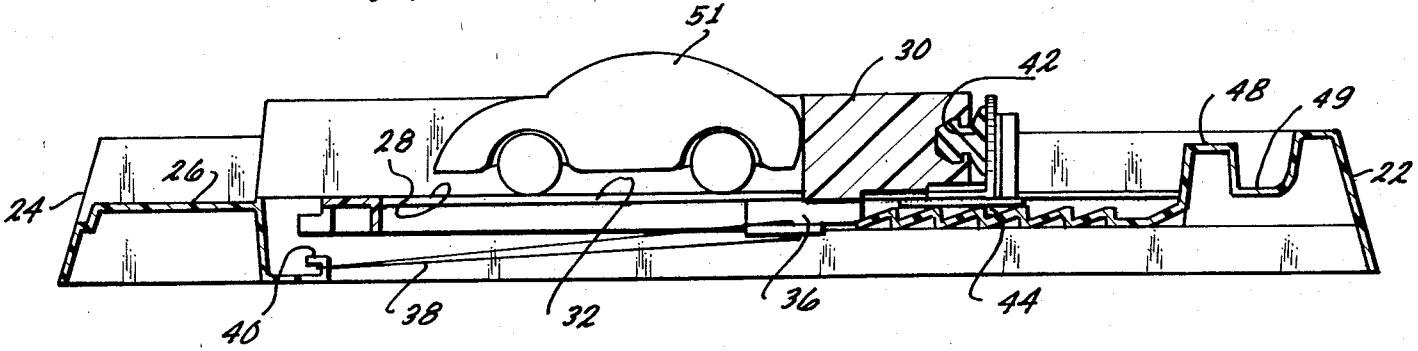
FIG. 4 is another cross-sectional view of the launching device shown in FIG. 2 in a second position.

3 into a position such as is shown in FIG. 4, the device 38 is placed in tension creating a force tending to direct the impeller 30 to the left (see FIG. 4).

Figure 3:
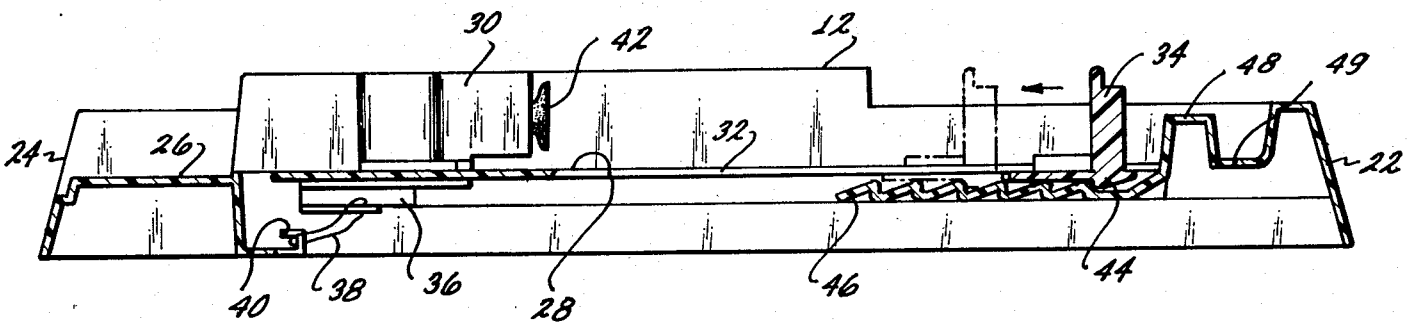
FIG. 3 is a cross-sectional view of the launching device shown in FIG. 2.

The impeller 30 supports a high volume bellows or suction cup 42 on its right surface as is shown in FIG. 3 and when the impeller 30 is moved to the right, the suction cup 42 may be made to adhere to the left surface of the selector 34. The selector 34 has a downwardly depending detent 44 which may be positioned in one of any number of matching depressions in a resilient finger 46. The finger 46 is unconnected at its left end as shown in FIGS. 3 and 4 and is connected to a button 48 at its right end. The button 48 is connected to the base 22 by a web 49 which acts as a spring normally holding the finger 46 against the detent 44.

Each of the elements of the launching device 12 (other than the device 38) may be constructed of a material such as a moldable plastic which may be easily manipulated in the construction of an arrangement such as that shown in the drawings by those skilled in the art.

When the impeller 30 is pushed to the right so that the suction cup 42 is pressed tightly against the left surface of the selector 34 and the detent 44 thereof projects into a notch of the finger 46, the impeller 30 is held in place for a predetermined period of time, dependent on the volume of the bellows 42. The force caused by the device 38 on the impeller 30 tends to pull the impeller 30 to the left. If a toy vehicle 51 is placed ahead of the impeller 30 in the position shown in FIG. 4 and the button 48 is depressed before the release of the bellows 42, the selector 34 is released allowing the impeller 30 to be pulled rapidly to the left projecting the car along the track 16 toward the bridge 14 in the arrangement shown in FIG. 1.

Alternatively, if the volume of the suction cup 42 is selected appropriately, once the selector 34 has the bellows adhered to it, with the detent 44 resting in a recess of the finger 46, the force pulling to the left on the impeller 30 causes the impeller 30 to pull the suction cup 42 away from the left face of the selector 34 after a predetermined period of time. Such a timing or delay arrangement may be used to provide a selected delay so that a single player using the playset may reach the actuator 13 and prepare for the projection of the car down the track 16.

It should be noted that by placing the detent 44 at varying positions along the finger 46, the force applied to the launcher 30 may be varied. This allows the operator to adapt the amount of force which is applied to the impeller 30 and thereby vary the time in which a toy vehicle will reach the bridge 14.

Figure 6:
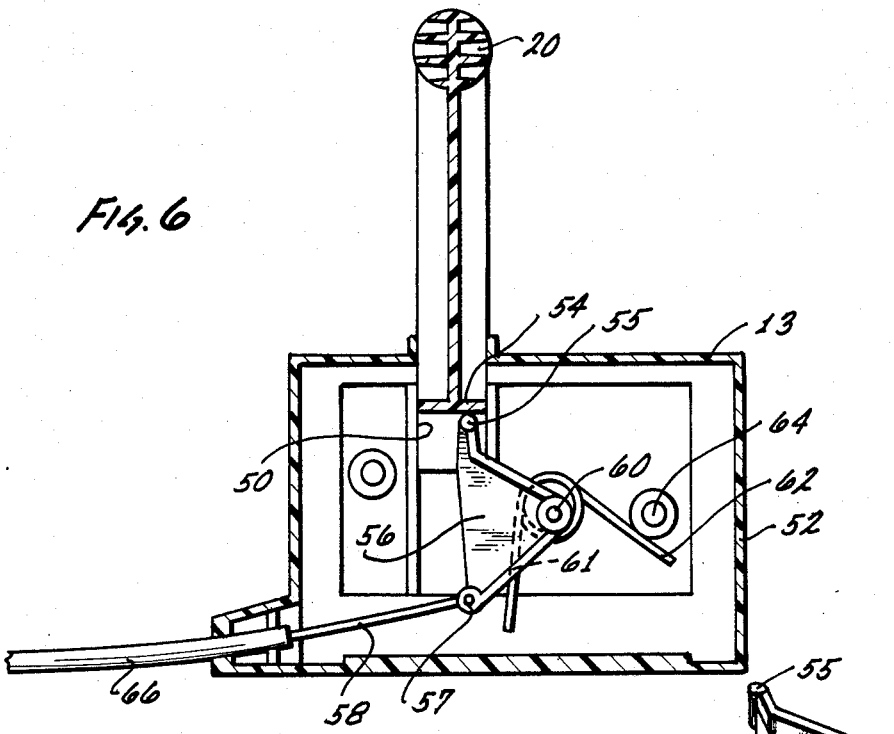
FIG. 6 is a cross-sectional view of the actuator device shown in FIG. 5.
Figure 7:
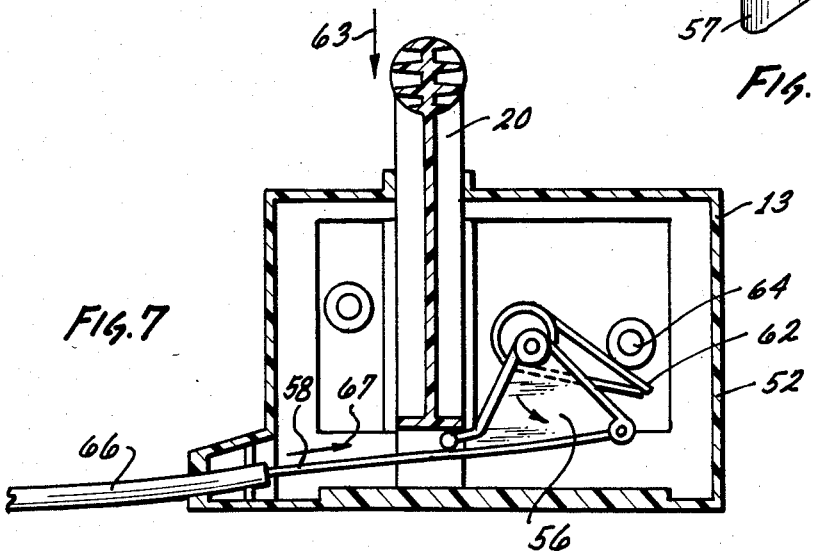
FIG. 7 is another cross-sectional view of the actuator device shown in FIG. 5.

The actuator 13 is shown in perspective in FIG. 5 and in cross-section in FIGS. 6 and 7. The actuator 13 has projecting from the upper surface thereof the plunger 20 which moves vertically and is maintained in position by a shaftway 50 internal to a box-like body 52. A base 54 of the plunger 20 presses against one end 55 of a triangular member 56. Another end 57 of the triangular member 56 is connected to a wire 58. The triangular member 56 is pivoted on an axis about a post 60 extending inwardly from the body 52. A spring 62 underlies the member 57 about the axis 60 and has a first end adjacent to and held in place by a post 64 of the body 52 and a second end which projects through a hole 61 in the triangular member 56 to place a bias thereon. When the plunger 20 is depressed in the direction shown by the arrow 63 in FIG. 7, the triangular piece 56 is moved in the direction shown by the arrow 65, tightening the spring 62 and drawing the wire 58 to the right as shown by arrow 67 in FIG. 7. The wire 58 runs through a sheath 66 to the bridge 14 as is shown in FIG. 1. When the plunger 20 is released, the spring 62 returns the member 56 and the plunger 20 to their original positions.

Figure 6A:
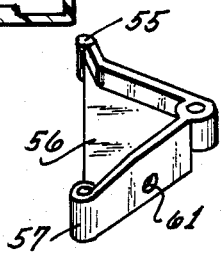
FIG. 6(A) is a perspective view of a detail shown in FIGS. 6 and 7.

FIG. 6(A) is an enlarged perspective view of the triangular member 56 illustrating the construction of this member.

Figure 8:
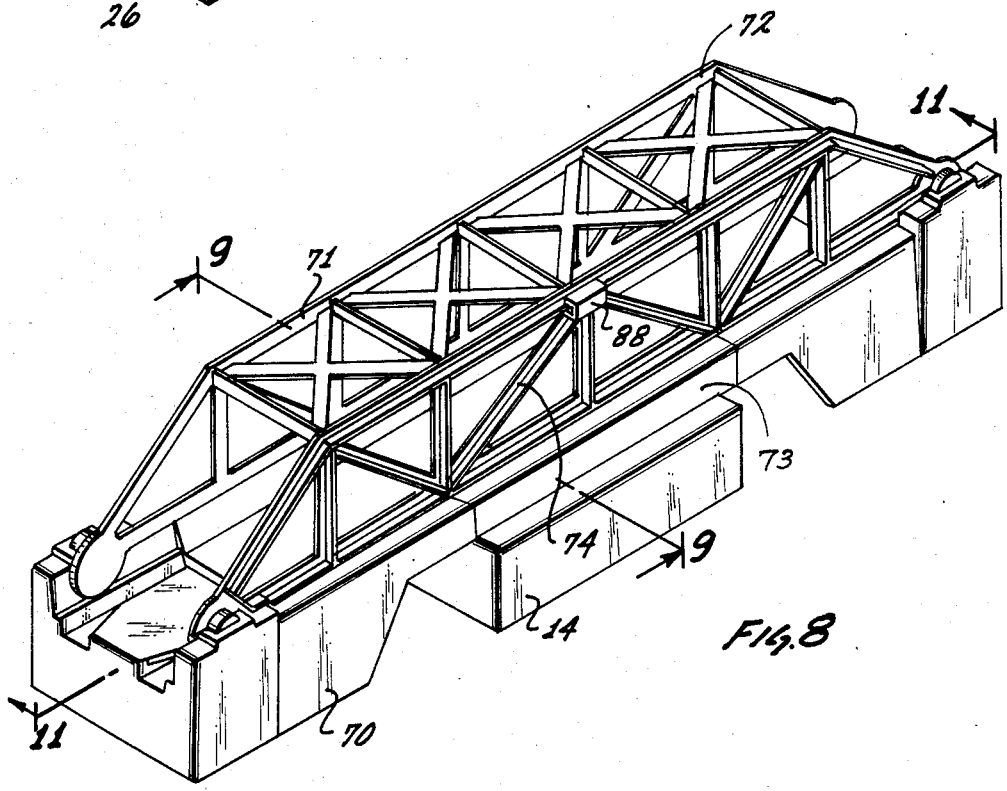
FIG. 8 is an enlarged perspective view of a bridge portion of the arrangement shown in FIG. 1.
Figure 9:
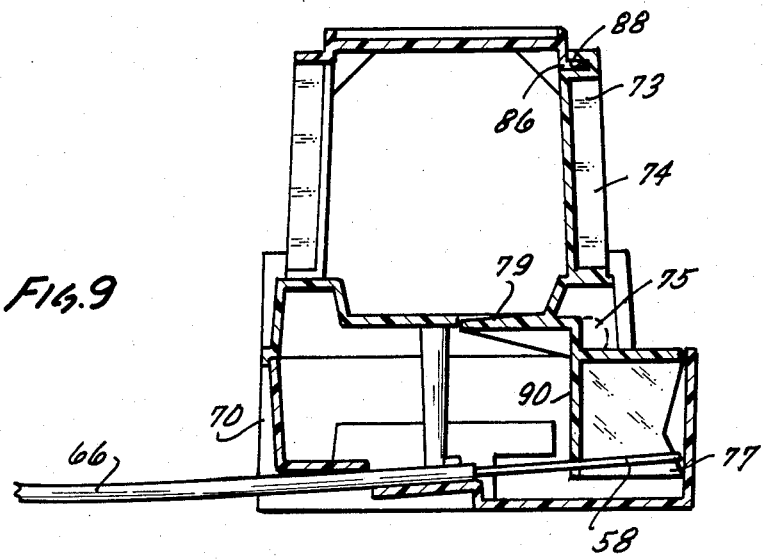
FIG. 9 is a cross-sectional view of the bridge portion of FIG. 8 taken along line 9—9.
Figure 10:
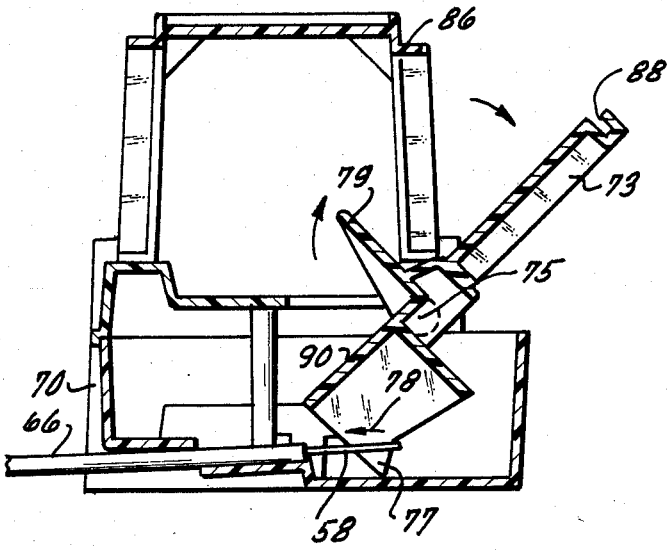
FIG. 10 is another cross-sectional view of the bridge portion shown in FIG. 8.

FIG. 8 is an enlarged perspective view of the bridge 14 shown in FIG. 1, and FIG. 9 is a cross-section taken along line 9—9 of FIG. 8. FIG. 10 is an additional cross-section of the bridge 14, also taken along line 9—9 of FIG. 8. These figures together with FIG. 11 illustrate various positions of the parts of the bridge 14 during the operation thereof in response to the depression of the plunger 20.

Figure 11:
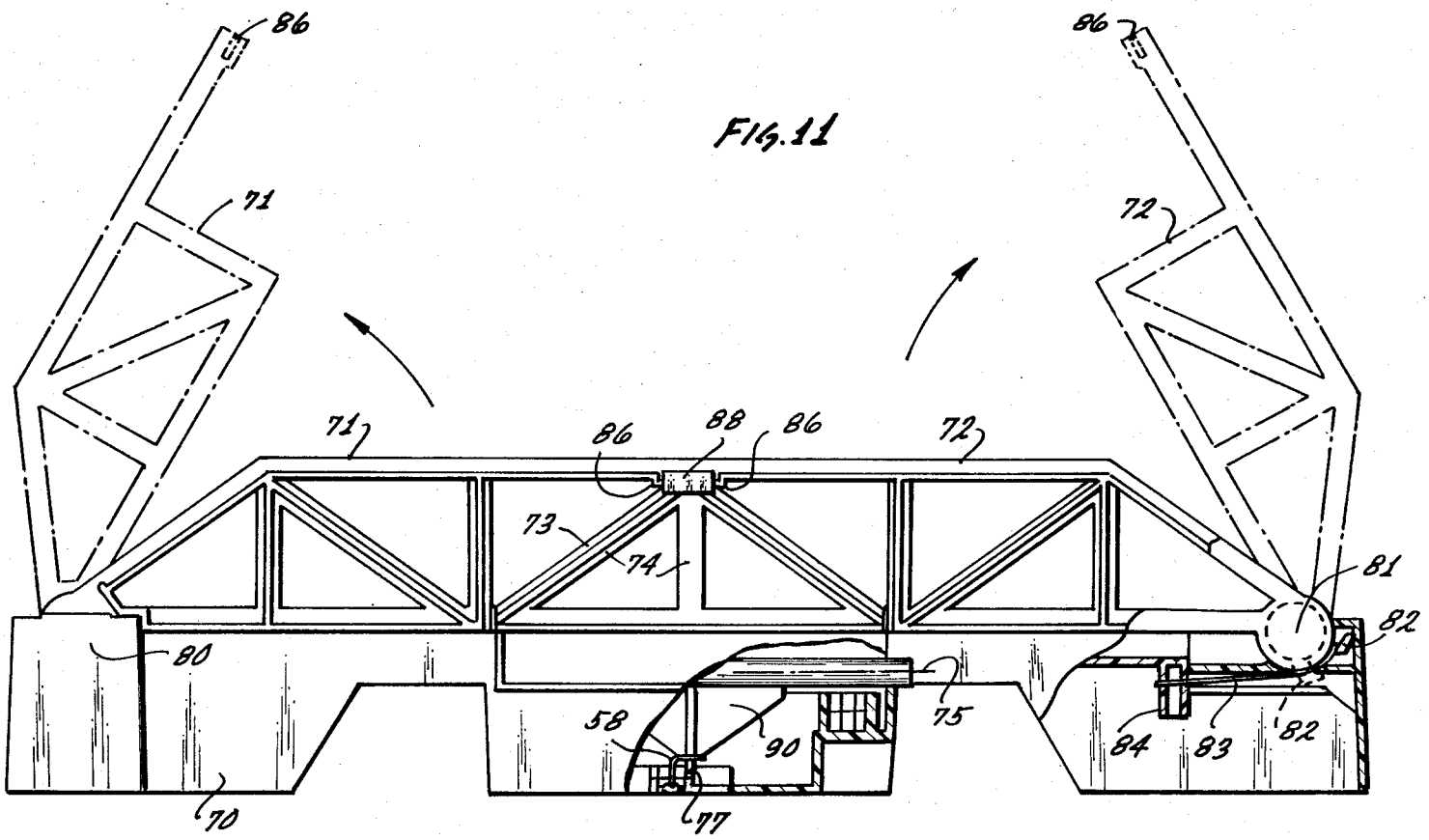
FIG. 11 is a side view of the bridge, partially in cross-section, shown in FIG. 8.

As may be best seen in FIGS. 8 and 11, the bridge 14 comprises a lower section 70 and three upper portions 71, 72, and 73. The portion 73 includes an upstanding vertical triangular member 74 which appears in essentially the central third of the right hand side of the bridge superstructure as shown in FIG. 8. Portion 73 which emulates a bridge rail pivots on an axis 75 which is parallel to the length of the bridge and approximately at road level on the right side of the bridge. Such a pivoting action causes the portion 73 to pivot outward from the track as is shown in FIGS. 10 and 11.

The pivoting action of the portion 73 about the axis 75 is caused by the wire 58 which projects through the sheath 66 and attaches at the base of the portion 73 on a projecting detent 77 thereof. As will be appreciated by those skilled in the art, the sheath 66 is held in place within the base 70 of the bridge 14 so that a depression of the plunger 20 of the actuator 13 which causes the movement of the wire 58 to the right as shown in FIG. 7, causes the movement of the same wire 58 to the left as shown by arrow 78 in FIG. 10. When the plunger 20 is released by the operator and the spring 62 (shown in FIGS. 6 and 7) returns the triangular piece 56 to its uppermost position, the wire 58 is directed to the left in FIGS. 6 and 7 and to the right in FIG. 10. This allows the portion 73 to rotate back into its vertical position.

As is shown in FIGS. 9 and 10, the portion 73 also includes a projection 79 at right angles to the upstanding portion. The projection 79 is shaped to comprise a flat portion of the track 16 within the bridge 14. Thus, when the portion 73 is rotated to the right in FIG. 10 away from the vertical, the element 79 is raised. If this takes place rapidly due to the rapid depression of the plunger 20, then any toy vehicle which happens to be on that portion of the track 16 is projected upwardly as though an explosion had occurred under the vehicle.

The portions 71 and 72 of the bridge 14 rotate about axes 80 and 81, respectively, which are approximately at track level parallel to the surface of the track 16 and perpendicular to the length of the bridge 14. Each of the elements 71 and 72 has a projection 82 which retains one end of an elastic band 83, the remainder of which is directed about one or more posts 84 in the base 70 of the bridge 14. Each of the elements 71 and 72 has a projection 86 at its end furthest from its axis of rotation. This projection 86 of each of the elements 71 and 72 is adapted to mate with a notch 88 in the upper end of the vertical member 74 of the portion 73 when it is in its vertical position. The notch 88 holds the two elements 71 and 72 in their lowered positioned so long as the portion 73 is in its upright position.

When the plunger 20 is depressed causing the portion 73 to rotate outwardly from the centre of the bridge as is shown in FIG. 10, elements 71 and 72 are released at each of their projections 86 and the elastic band 83 connected to each causes each element 71 and 72 to rotate upwardly to the position shown in dotted lines in FIG. 11.

If a toy vehicle is passing over the bridge 14 at the instant the portion 73 rotates outwardly, it will be projected upward by the projection 79 while the elements 71 and 72 rotate upwardly and the portion 73 rotates outwardly. This action appears to those viewing the operation of the arrangement 10 as though an explosion had caused the vehicle to be thrown from the bridge 14. Alternatively, if the operator mistimes the depression of the plunger 20 so that the vehicle has already passed the center of the bridge 14 at the time the portion 73 swings outwardly, the vehicle continues on to be counted by the counter 18 in a manner well known to the prior art to give an indication of scoring. The arrangement of portion 73 is such that if the plunger is operated too soon, a surface 90 is rotated into position at the level of the track 16 on the bridge 14 so that a vehicle may continue across and be counted by the counter 18.

Most of the elements of the arrangement 14 may be constructed of a material such as a moldable plastic material well known to those skilled in the art which provides a relatively resilient and sturdy arrangement.

It is to be understood that various other arrangements than those shown in the specification will occur to those skilled in the art without departing from the spirit and scope of the invention. It is therefore to be understood that the invention is to be limited only by the scope of the claims appended hereto.

What is claimed is:

1. A toy bridge for a toy race set comprising a roadway defining a path of travel for toy vehicles, a rotating section of the roadway being mounted to pivot about an axis paralleling the path of travel of the roadway, trigger means responsive to user command for causing the rotating portion of the roadway to rotate out of the path of travel thereby interrupting the path of travel, at least one spring-loaded overhead bridge element rotatably mounted to pivot about an axis perpendicular to the path of the roadway, means for retaining the overhead bridge element in a position covering the roadway, and means responsive to the trigger means for releasing the overhead bridge element to rotate upwardly from the roadway simultaneously with the rotation of the rotating section of the roadway out of the path of travel.

2. A toy bridge for a toy race set as claimed in claim 1 further comprising a roadway defining a path of travel for toy vehicles, a first section normally positioned in the roadway and mounted to pivot about an axis so that it may be rotated out of the path of travel of the roadway thereby interrupting the path of travel, a second section being mounted to pivot about an axis so that it may be rotated into the normal position of the first section, and trigger means responsive to user command for simultaneously rotating the first section out of the roadway and the second section into the roadway so that for a short selectable period of time the path of travel is interrupted.

3. A toy bridge as claimed in claim 2 further comprising means for remotely actuating the trigger means.

* * * * *